United States Patent [19]

Sakamaki et al.

[11] Patent Number: 4,656,855

[45] Date of Patent: Apr. 14, 1987

[54] CROWN CONTROL METHOD FOR A MULTI-ROLL ROLLING MILL

[75] Inventors: Hirokichi Sakamaki; Tadao Nakayama, both of Kobe, Japan

[73] Assignee: Kabushiki Kaisha Kobe Seiko Sho, Kobe, Japan

[21] Appl. No.: 785,403

[22] Filed: Oct. 8, 1985

[30] Foreign Application Priority Data

Oct. 22, 1984 [JP] Japan ..... 59-222469

[51] Int. Cl.[4] ..... B21B 37/00

[52] U.S. Cl. ..... 72/8; 72/242; 72/243

[58] Field of Search ..... 72/8, 9–13, 72/242, 243, 241, 19, 17, 244

[56] References Cited

U.S. PATENT DOCUMENTS 3,054,310 9/1962 Varner ..... 72/243 X
4,244,025 1/1981 Alshuk ..... 72/9

FOREIGN PATENT DOCUMENTS 0116914 7/1983 Japan ..... 72/243
0016605 1/1984 Japan ..... 72/241

*Primary Examiner*—Robert L. Spruill
*Assistant Examiner*—Steve Katz
*Attorney, Agent, or Firm*—Oblon, Fisher, Spivak, McClelland & Maier

[57] ABSTRACT

A method is set forth for use in crown control in a multi-roll rolling mill, the method including the steps of: setting in advance a shape of a thermal crown of a work roll corresponding to various rolling conditions and a changing gradient of a mechanical crown for each rolling speed zone applied to a work roll which is determined according to a change in time of a thermal crown relative to a change in rolling speed; applying a roll bending force, as an initial value, to the work roll, controlling the roll bending force from the thermal crown shape and an initial value of a mechanical crown amount at a suitable position of the work roll which is determined from an expected rolling schedule and a target mechanical crown amount at a standing speed; detecting the rolling speed; selecting the changing gradient of the mechanical crown according to the rolling speed zone at that time; and at the same time adjusting the roll bending force applied to the work roll.

1 Claim, 8 Drawing Figures

CROWN CONTROL METHOD FOR A MULTI-ROLL ROLLING MILL

BACKGROUND OF THE INVENTION

1. Field of the Invention

The present invention relates to a crown control method for a multi-roll rolling mill.

2. Description of the Prior Art

As a multi-roll rolling mill of this kind, a 12-high rolling mill, for example, as shown in FIGS. 6 and 7, has been heretofore known. An upper roll housing 1 supporting a group of upper rolls is vertically movably fitted in four posts 3 stood upright on a lower roll housing 2 supporting a group of lower rolls, and the group of upper rolls is screwed down by driving a worm wheel 8 meshed with said posts 3 by a screw-down motor 4 provided on the upper roll housing 1 through a worm 5, a worm wheel 6, a shaft 7 and a worm (not shown). The groups of upper and lower rolls each comprise work rolls 9, 10, two sets of intermediate rolls 11, 12 supporting said work rolls, and three sets of support rolls 13(*b*), 13(*a*), 13(*c*) supporting said intermediate rolls. Between each saddle 15 of a support roll 13(*b*) on inlet and outlet sides of the rolling mill and the upper roll housing 1 are formed a pair of wedge blocks 16, 17 for each saddle 15, wedge block 17 being vertically moved through a driving shaft 19 by means of a plurality of driving means 18 provided on the upper roll housing 1. This vertical movement of the wedge block 17 causes a fine adjustment of displacement of the saddles to control crowns of the work rolls 9, 10.

In the above-described 12-high rolling mill, an operator judges a mechanical crown amount applied to the work rolls while observing a plate shape on the outlet side of the rolling mill, and suitably manually drives the driving means 18 which vertically move the wedge block 17 to thereby adjust the crown of the work rolls.

However, recently, with the requirement of higher precision in the shapes of products and with the requirement of high productivity resulting from an increase in demand, the rolling speed is inevitably increased in speed. However, in the crown adjustment done by hand in the prior art, it is difficult not only to provide higher precision shapes but to maintain such precision. Indeed, it is impossible to cope, particularly, with a variation in shape of plate due to an acute variation of a thermal crown at the time of acceleration and deceleration. This yield is so poor as to deteriorate productivity.

SUMMARY OF THE INVENTION

It is therefore an object of the present invention to provide a crown control method in a multi-roll rolling mill which can automatically set a mechanical crown amount applied to work rolls according to a rolling speed to compensate for a thermal crown.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

According to the present invention, there is provided a crown control method in a multi-roll rolling mill, the method comprising: setting in advance a shape of a thermal crown of a work roll corresponding to various rolling conditions and a changing gradient of a mechanical crown for each rolling speed zone applied to a work roll which is determined according to a change in time of a thermal crown relative to a change in rolling speed; applying a roll bending force, as an initial value, to the work roll, said roll bending force being operated from said thermal crown shape and an initial value of a mechanical crown amount at a suitable position of the work roll which is determined from an expected rolling schedule and a target mechanical crown amount at a standing speed; detecting the rolling speed; selecting the changing gradient of said mechanical crown according to the rolling speed zone at that time; and simultaneously adjusting the roll bending force applied to the work roll.

One embodiment of the present invention will now be described with reference to the drawings.

Figure 3:
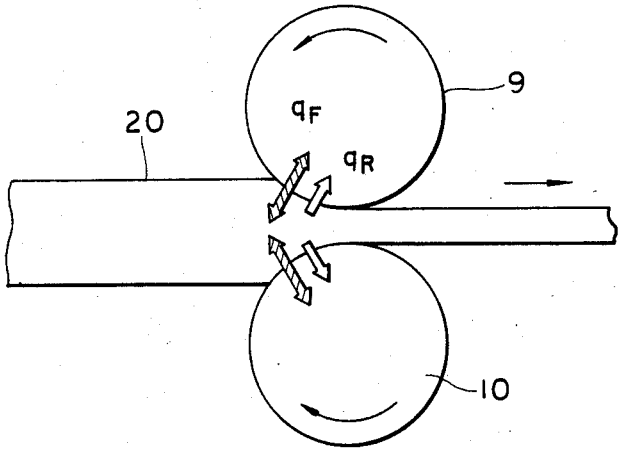
FIG. 3 shows the flow of heat into and out of rolls.

First, the relation between the thermal crown of the work roll and the rolling speed will be described. Heat generation at the rolls during rolling comprises, as shown in FIG. 3, heat generation due to the plastic deformation of a rolling material 20 and heat generation due to the friction between work rolls 9, 10 and the rolling material 20. The former heat flows into the work rolls 9, 10 due to the heat transfer, and the latter heat flows, in a fixed distribution rate, into the work rolls 9, 10 and the rolling material 20. It is known that where q is the heat flowing into the work roll 9, 10, $q_F$ is the heat due to the frictional heat and $q_R$ is the heat due to the plastic deformation, the following relation is established: ti $$q = q_F + q_R \quad \text{(A)}$$

$$q_F \alpha \omega \cdot \mu \cdot Vs \cdot ts \cdot Pm \quad \text{(B)}$$

$$q_R \alpha \lambda_1 \cdot \lambda_2 \cdot ts \cdot \omega / (\lambda_1 \sqrt{d_2} + \lambda_2 \sqrt{d_1}) \quad \text{(C)}$$

where

- $\omega$: angular velocity of the work roll
- $\mu$: frictional coefficient
- Vs: average relative speed of a rolling material and a work roll
- ts: contact time of a rolling material and the work roll
- Pm: average screw-down force
- $\lambda_1$, $\lambda_2$: heat conductivity of a rolling material and work roll
- $d_1$, $d_2$: temperature conductivity of a rolling material and work roll As will be apparent from the above-described formulae, the heat q flowing into the work roll is proportional to the angular velocity $\omega$ of the work roll, i.e., the rolling speed. Accordingly, the work roll increases in temperature and expands due to the head q flowing into the work roll, and therefore the thermal crown of the work roll exhibits behavior similar to the change in rolling speed.

Figure 4A:
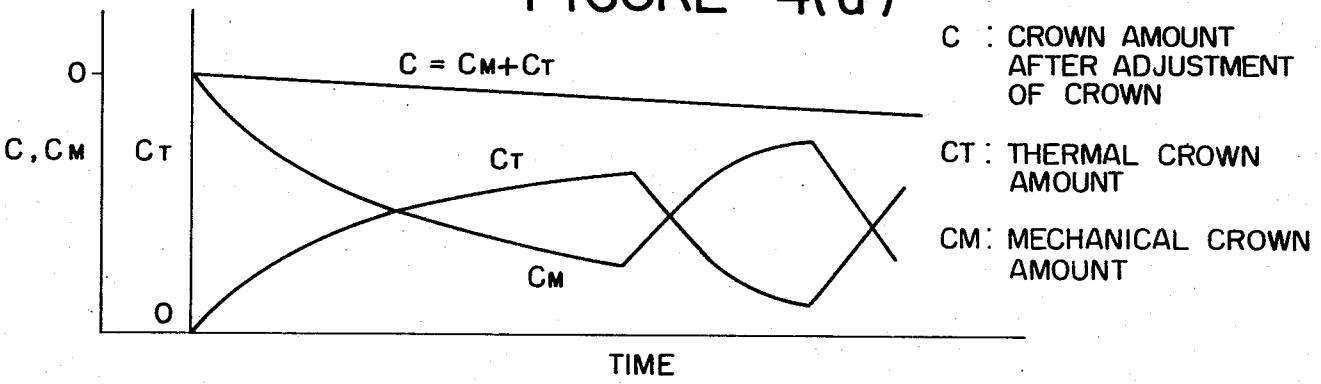
FIGS. 4*a* and 4*b* each show the concept of the mechanical crown control method.
Figure 4B:
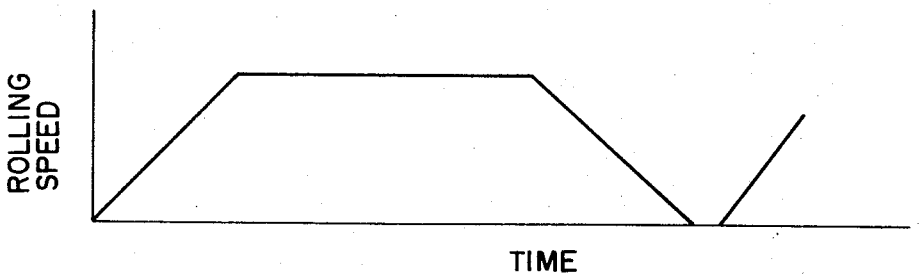
Figure 6:
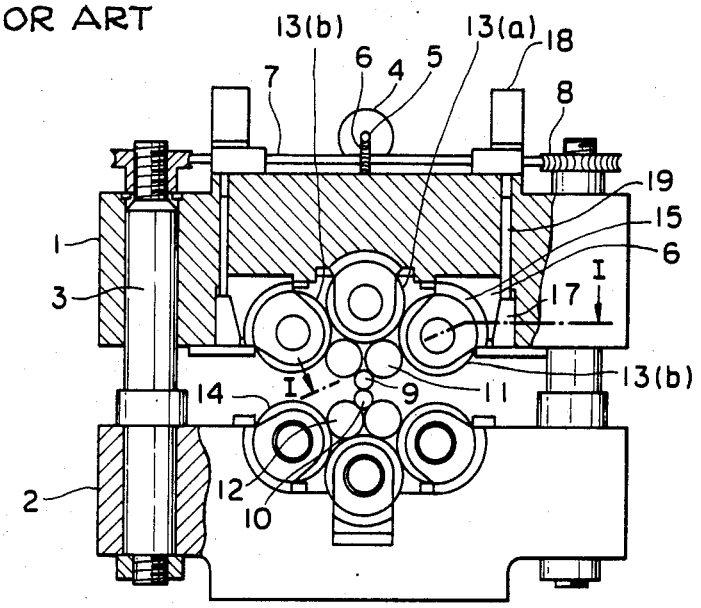
FIGURE 6 PRIOR ART
FIG. 6 is a front view partly sectioned of a conventional 12-high rolling mill.
Figure 7:
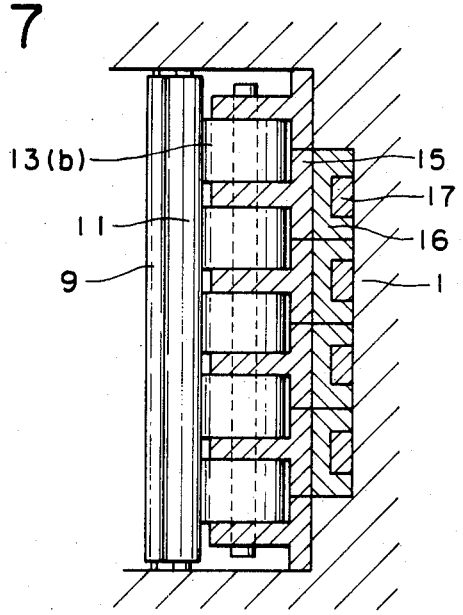
FIGURE 7 PRIOR ART
FIG. 7 is a sectional view taken on line I—I.

The above-described fact has been assured by present inventors, even in the actual rolling. For example, FIG. 4*a* shows a change in thermal crown amount $C_T$ at a point in an axial direction of the work roll with respect to a change in rolling speed shown in FIG. 4*b* under a certain rolling condition and a change in mechanical crown amount $C_M$ corresponding thereto and a crown amount C after the crown has been adjusted. The thermal crown amount $C_T$ varies in good corresponding relation for the respective speed zones of, acceleration, standing speed and deceleration.

Since the thermal crown of the work roll as described directly affects on a sectional shape of a rolling material, it is necessary to adjust and control the thermal crown so as to offset it in some manner. Where the work roll has an extremely small diameter, say 40 to 100 mm, and has a small heat capacity, as in the multi-roll rolling mill to which the present invention is applied, it is suitable that the change in thermal crown is relatively quickly compensated for by the mechanical crown (crown adjusting amount).

FIG. 4*a* shows the concept of the mechanical crown controlling method. As previously mentioned, the thermal crown of the work roll varies in good corresponding relation relative to the change in rolling speed as shown by the curve of $C_T$ shown in FIG. 4*a*. The mechanical crown controlling is carried out so that the bending force is applied to the work rolls by mechanical means to provide the mechanical crown amount $C_M$ opposite to the thermal crown to thereby offset the thermal crown whereby even if the rolling speed is changed, the crown of the work roll is maintained substantially constant. In FIG. 4*a*, the crown amount after adjustment of the crown decreases over time because the whole rolling mill system including the intermediate rolls behind the work rolls, the support rolls, the rolling mill housing and the like tends to be increased in temperature as rolling takes place.

Figure 1:
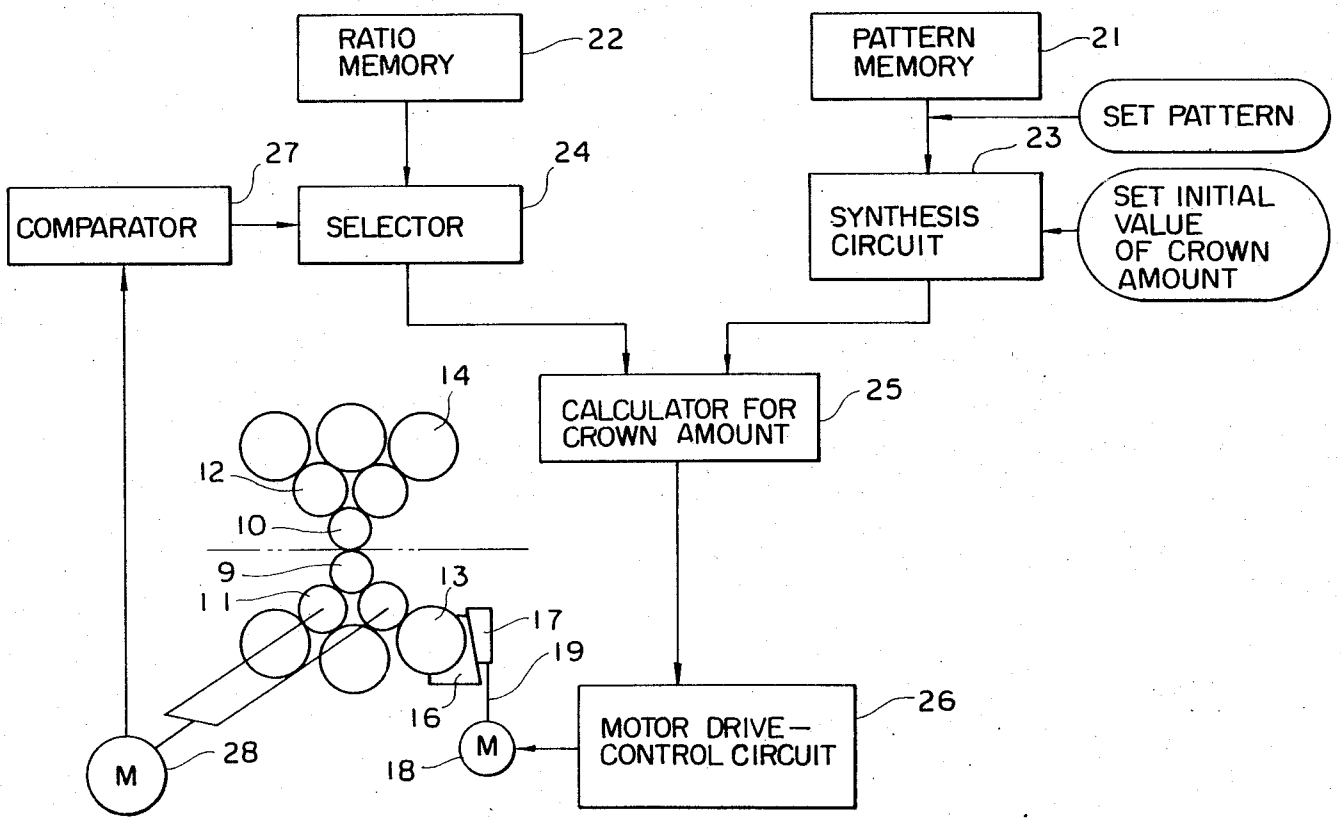
FIG. 1 is a diagram showing a control circuit of a 12-high rolling mill to which the method according to the present invention is applied.

Referring now to FIG. 1, which shows a 12-high rolling mill to which the crown control method according to the present invention is applied, body parts of the multiroll rolling mill except the control circuit are substantially the same as those of the aforementioned prior art, and parts corresponding thereto are indicated by the same numerals, description of which is omitted.

The control circuit comprises a pattern memory 21, a ratio memory 22, a synthesis circuit 23, a selector circuit 24, a crown amount calculator circuit 25, a motor drive-control circuit 26 and a comparator circuit 27.

Figure 5:
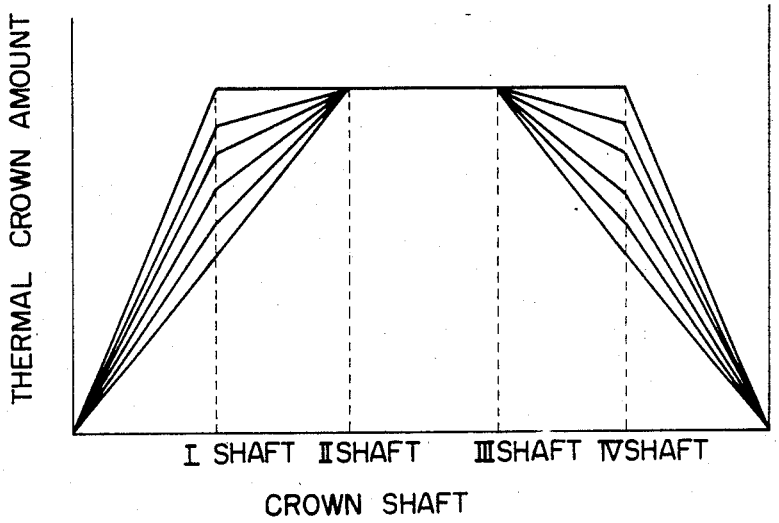
FIG. 5 shows the shapes of a fixed form of various thermal crowns.

In the pattern memory 21, several shapes of a thermal crown corresponding to various rolling conditions are stored in advance therein, and one of these shapes are selected prior to starting of rolling and the selected shape of the thermal crown is put into the synthesis circuit 23. The shapes of the thermal crown stored herein are those wherein thermal crowns obtained by calcultion relative to the various rolling conditions or on the basis of actual measurement are fixed in form as shown in FIG. 5 for every rolling condition. More specifically, the shapes of the thermal crown are fixed in form and stored by linearly indicating the ratio of the thermal crown amount at each point in an axial direction of the work roll corresponding to a driving shaft 19 of the wedge block 17 for every rolling condition. Thus, if the absolute value of the thermal crown amount at a certain point in the axial direction of the work roll is obtained, the thermal crown amount may be determined over the entire area of the work roll from the fixed-form shape of the thermal crown.

The ratio memory 22 stores therein those values wherein the changing gradient of the mechanical crown applied to erase the change of the thermal crown relative to the change in rolling speed is fixed in form. Either gradient is selected by the selector circuit 24. That is, the changing gradients of the mechanical crown applied for respective speed zones, i.e., high speed standing speed zone, low speed zone, acceleration zone and deceleration zone are controlled and they are stored as K1, K2, K3 and K4, respectively. For example, in FIG. 4*a*, the curve $C_M$ of the mechanical crown is approximated in straight line for the respective acceleration zone, high speed standing speed zone and deceleration zone, gradients of which are used as K3, K1 and K4, respectively.

The synthesis circuit 23 synthesizes a thermal crown shape selected from the pattern memory 21 by setting a pattern from outside and an initial value of a mechanical crown amount at a certain point in an axial direction on the work roll set from the outside to operate the initial value of the mechanical crown amount applied to each point of the work roll corresponding to the respective driving shaft 19 (I, . . . , IV shaft) of the wedge block 17, and the result therefrom is put into the crown amount calculator 25.

The thermal crown shape selected from the pattern memory 21 is the ratio of the thermal crown amount at each point in the axial direction of the work roll, and therefore, the ratio is multiplied by minus 1 to convert it into the ratio of the mechanical crown amount to be applied, after which it is multiplied by the initial value of the mechanical crown amount at a certain point in the axial direction of the work roll set from outside to obtain an initial value of the mechanical crown amount applied to each point of the work roll corresponding to the respective driving shaft 19 (I, . . . IV shaft).

The initial value of the mechanical crown amount at a certain point in the axial direction of the work roll set from outside is determined in the following manner.

The mechanical crown amount required at the standing speed is easily obtained during the normal rolling operation. That is, the mechanical crown amount applied at the standing speed can be set on the basis of the experience or calculation. Therefore, the mechanical crown amount applied at the standing speed is preset as the target mechanical crown amount for every rolling condition. The changing gradients K1, . . . K4 of the mechanical crown to be applied are suitably assumed on the basis of the accelerating procedure before the standing speed of the expected rolling schedule. Then, the reverse operation is made, to calculate the initial value, from the target mechanical crown amount at the standing speed and the assumed changing gradient of the mechanical crown.

The comparator 27 detects the rolling speed from the number of revolutions of the driving motor 28 of the intermediate rolls 11, 12, judges in which speed zone the rolling speed is in, and puts the result of said judgement into the selector 24.

The selector 21 selects the changing gradient of the mechanical crown corresponding to the speed zone of the rolling speed detected and judged by the comparator 27, from the K1, . . . K4 stored in the ratio memory 22, and puts the gradient into the crown amount calculator 25.

In the crown amount calculator 25, the changing gradient of the mechanical crown selected by the selector 24 is multiplied by the initial value of the mechanical crown amount from the synthesis circuit 23 or the mechanical crown amount in the preceding stage to thereby calculate the mechanical crown amount to be applied to each point of the work roll corresponding to the respective driving shaft 19 (I, . . . IV shaft) in the succeeding stage.

The motor driving control circuit 26 calculates the roll bending force necessary for applying the mechanical crown amount calculated by said crown amount calculator 25 to the work rolls 9, 10 and drives the drive means 18 for moving the wedge block 17 up and down for applying the roll bending force to the work rolls 9, 10.

Figure 2:
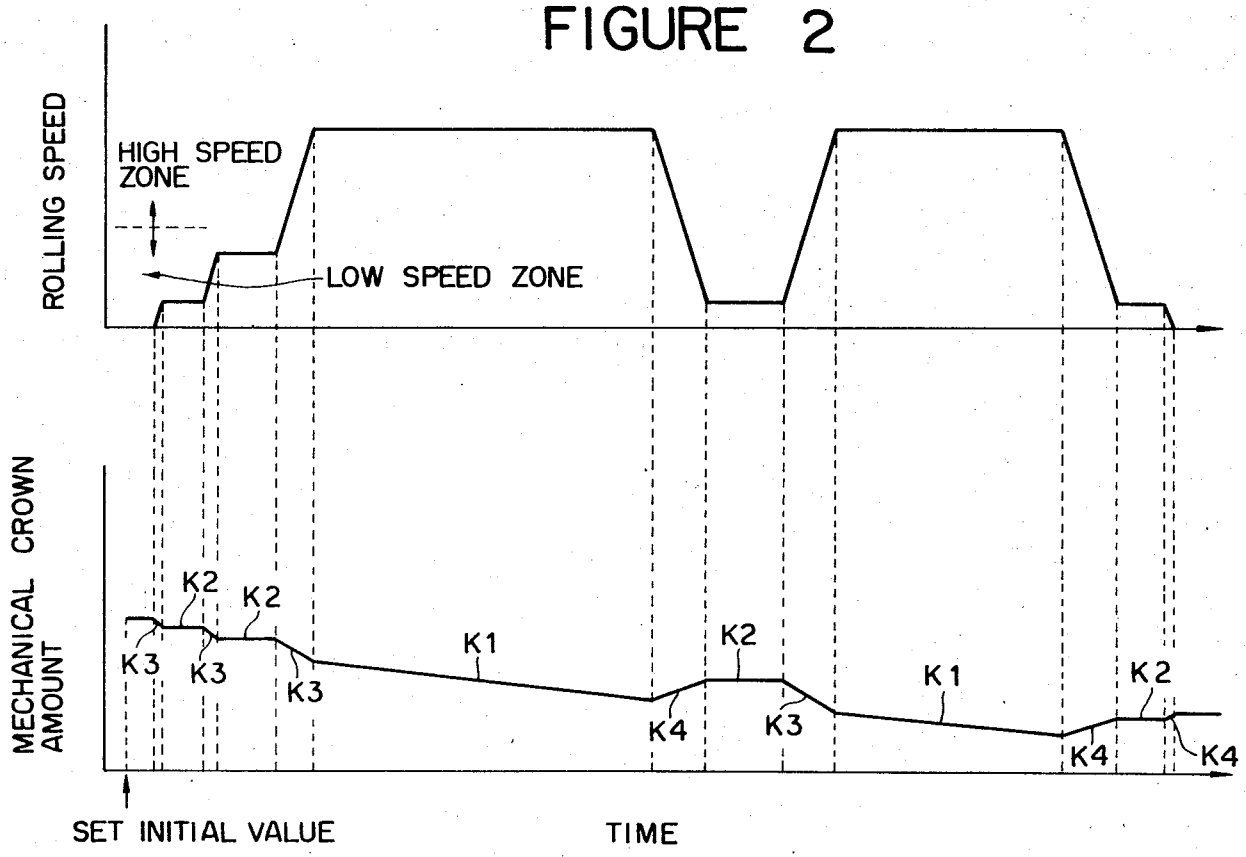
FIG. 2 is a graph showing a mode of a change in mechanical crown amount to be controlled relative to a change in rolling speed.

FIG. 2 shows the change of the mechanical crown amount applied to a certain point of the work roll after being controlled by the crown control method of the present invention as described above. In FIG. 2, after the initial value of the mechanical crown amount has been set, rolling is started so that the rolling speed is successively changed from the acceleration zone toward the low and high standing speed zones and at the same time, one gradient corresponding to the respective speed zone among the changing gradients K1, . . . K4 of the fixed-form mechanical crown is selected to determine the mechanical crown amount at that time.

As will be apparent from the above-described explanation, according to the present invention, if the thermal crown shape with respect to the rolling condition and the initial value of the mechanical crown amount to be applied are set prior to rolling, even any rolling speed zone, the mechanical crown amount according to the rolling speed thereof is automatically controlled and applied to the work rolls. Therefore, the change in shape of the rolling material can be minimized even against the acute change in thermal crown particularly in the acceleration and deceleration zones.

In addition, rolling material in the acceleration and deceleration zones in which an operator is not able to perform the operation in prior art can be made into other products, and therefore, both the yield is enhanced and productivity increases.

Moreover, since any special equipment such as a shape detector need not be provided, it is possible to perform the crown control by inexpensive means.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A crown method in a multiroll rolling mill, which comprises:

setting in advance a plurality of shapes of a thermal crown of a work roll corresponding to a mechanical crown applied to a work roll;

applying a roll bending force, as an initial value, to the work roll;

controlling said roll bending force from said thermal crown shape and an initial value of a mechanical crown amount at a suitable position of the work roll determined from a predetermined rolling schedule and a target mechanical crown amount at a standing speed;

detecting the rolling speed;

selecting a changing gradient of said mechanical crown amount according to a rolling speed zone at that time; and simultaneously adjusting the roll bending force applied to the work roll.

* * * * *